US010605419B2

(12) United States Patent
Jones et al.

(10) Patent No.: US 10,605,419 B2
(45) Date of Patent: Mar. 31, 2020

(54) LIGHTING FIXTURE FOR SLOPED CEILING

(71) Applicants: Jonathan I. Jones, Highland, NY (US); Frank Cogliano, Pomona, NY (US); Howard D. Delano, Kingston, NY (US)

(72) Inventors: Jonathan I. Jones, Highland, NY (US); Frank Cogliano, Pomona, NY (US); Howard D. Delano, Kingston, NY (US)

(73) Assignee: USAI, LLC, New Windsor, NY (US)

( * ) Notice: Subject to any disclaimer, the term of this patent is extended or adjusted under 35 U.S.C. 154(b) by 0 days.

(21) Appl. No.: 16/168,307

(22) Filed: Oct. 23, 2018

(65) Prior Publication Data

US 2019/0120449 A1 Apr. 25, 2019

Related U.S. Application Data

(60) Provisional application No. 62/575,689, filed on Oct. 23, 2017.

(51) Int. Cl.

| | |
|---|---|
| ***F21S 8/02*** | (2006.01) |
| ***F21V 17/02*** | (2006.01) |
| ***F21V 7/00*** | (2006.01) |
| ***F21V 21/04*** | (2006.01) |
| ***F21V 21/30*** | (2006.01) |
| *F21Y 115/10* | (2016.01) |

(52) U.S. Cl.

CPC ..... *F21S 8/026* (2013.01); *F21V 7/0066* (2013.01); *F21V 17/02* (2013.01); *F21V 21/041* (2013.01); *F21V 21/30* (2013.01); *F21Y 2115/10* (2016.08)

(58) Field of Classification Search

CPC ..... F21S 8/026; F21V 7/0066

See application file for complete search history.

(56) References Cited

U.S. PATENT DOCUMENTS

| | | | | | |
|---|---|---|---|---|---|
| 4,623,956 | A * | 11/1986 | Conti | F21V 7/0025 | 362/148 |
| 5,145,249 | A * | 9/1992 | Bruckner | F21V 17/02 | 362/364 |
| 5,452,193 | A * | 9/1995 | Hinnefeld | F21S 8/02 | 362/148 |
| 5,526,245 | A * | 6/1996 | Davis | F21S 8/026 | 362/233 |
| 5,564,815 | A * | 10/1996 | Littman | F21S 8/028 | 362/147 |

(Continued)

*Primary Examiner* — Alexander K Garlen
*Assistant Examiner* — Christopher E Dunay
(74) *Attorney, Agent, or Firm* — St. Onge Steward Johnston & Reens LLC

(57) ABSTRACT

A recessed lighting fixture for installation in an inclined ceiling has an enclosure and a lighting assembly pivotal relative to the enclosure through a first and second range of relative angles such that an optical axis can be aligned vertically for the first and second ranges. First and second trim element are adapted for use with the first and second ranges of inclinations. The first and second trim elements have optical element aligned at different angles, and a relative angle between the optical elements and the reflector plane is less than or equal to 10 degrees. An angle indicator provides a proper relative angle of the lighting assembly and a trim indicator provides an indication of a proper trim element.

20 Claims, 9 Drawing Sheets

(56) References Cited

U.S. PATENT DOCUMENTS

| | | | | |
|---|---|---|---|---|
| 5,609,408 | A * | 3/1997 | Targetti | F21S 8/02<br>362/523 |
| 2013/0170232 | A1* | 7/2013 | Park | F21S 8/026<br>362/364 |
| 2017/0053569 | A1* | 2/2017 | Votolato | G09F 7/20 |

* cited by examiner

LIGHTING FIXTURE FOR SLOPED CEILING

FIELD OF THE INVENTION

The invention relates to lighting fixtures, and in particular, recessed lighting fixtures for inclined ceilings.

BACKGROUND OF THE INVENTION

Recessed light fixtures are known for "sloped ceilings" such as cathedral ceilings having an inclined, or sloped ceiling or inclined wall. Typically, the angle of the inclined wall can be indicated as a degree of incline or a pitch. The pitch is calculated by the number of inches it rises vertically for every 12 inches it extends horizontally. For example, a wall that rises 6 inches for every 12 inches of horizontal run has a 6-in-12 pitch (also 6/12 pitch). The sloped wall fixture is designed to work in walls within a range of pitches, for example from 3/12 pitch (14 degrees) to 12/12 (45 degrees).

It is often desirable to install recessed lighting fixtures in inclined ceilings, however known lighting fixtures suitable for inclined ceilings are often not suitable for, or have degraded optical performance, or installation difficulties for a desired range of inclined ceilings.

What is desired then is a recessed light fixture which is suitable for a range of inclined ceilings and which provide improved optical qualities and ease of installation.

SUMMARY OF THE INVENTION

What is desired then is a recessed light fixture which is suitable for a range of inclined ceilings and which provide improved optical qualities and ease of installation.

In an embodiment, the light fixture includes an enclosure having a bottom wall with an aperture, a lighting assembly disposed within the enclosure and including a lighting element pivotal relative to the enclosure about a pivot axis which is horizontal when the enclosure is mounted to the support structure. The lighting assembly is pivotal relative to the enclosure about the pivot axis through a first range of relative angles of at least 15 degrees, from a first relative angle to a second relative angle greater than the first relative angle such that the optical axis can be aligned vertically for a first range of inclinations of the inclined ceiling panel comprising the first range of relative angles.

The light fixture includes first and second trim element adapted for use with first and second ranges of inclinations which are configured to mount in the aperture from a room-facing side of the enclosure.

The light fixture includes an angle indicator visible through the aperture from the room-facing side of the enclosure and adapted to indicate a proper relative angle of the lighting assembly relative to the enclosure for vertical alignment of an optical axis of the lighting assembly for a plurality of inclinations of the enclosure in the first range of inclinations.

The light fixture includes a trim indicator visible through the aperture to indicate whether the first or second trim element is suitable for use in a particular inclination.

The lighting assembly includes a bubble level fixed thereto and visible through the aperture, and the bubble level is adapted to indicate when the optical axis is aligned in a predetermined orientation.

DETAILED DESCRIPTION OF THE INVENTION

Figure 1:
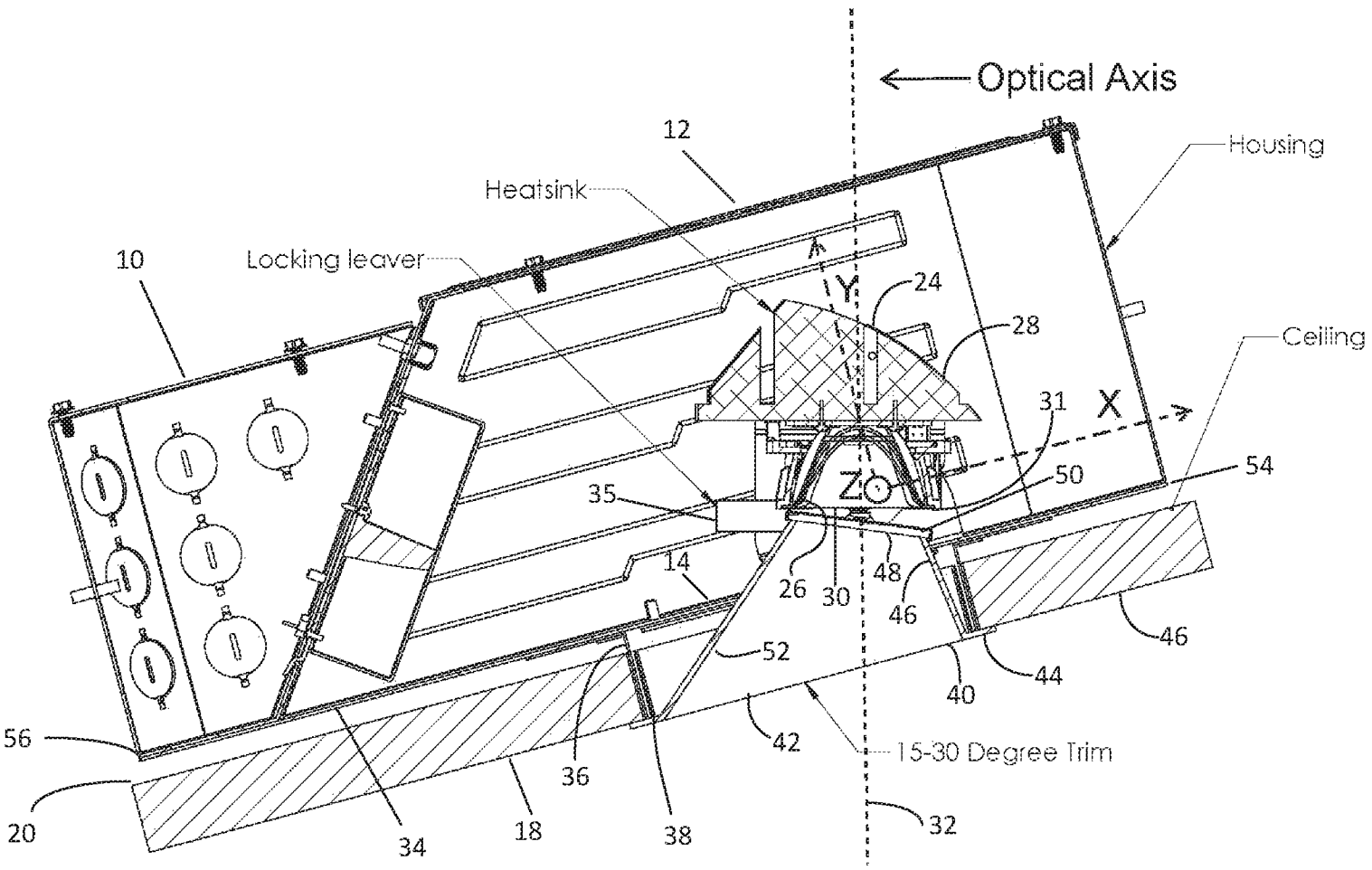
FIG. 1 is a side elevation view of a light fixture constructed according to the invention, showing the light fixture in a first inclination and with a first, low-incline trim element.

Referring to FIGS. 1-9, the recessed light fixture 10 is a "sloped ceiling" type light fixture and is particularly suitable for use in cathedral ceilings having an inclined, or sloped ceiling or inclined wall within a range of pitches, for example from 3/12 pitch (14 degree) to 12/12 (45 degree).

The recessed light fixture 10 has an enclosure 12 with an aperture 14 and has a lighting element 16 disposed within the enclosure, such as an LED lighting element, which is operable to emit light through the aperture 14 and into the room. The light fixture 10 is adapted to be mounted within the ceiling or wall structure that is above a ceiling or wall panel 18, adjacent to an interior surface 20 of the ceiling/wall panel 18 and is adapted to be secured and fixed relative to support structure, such as joists (not shown), within the ceiling/wall construction. The aperture 14 is aligned with an opening 22 in the ceiling/wall panel 18. Typically, the enclosure 12 is mounted to support structure prior to installation of the ceiling/wall panel 18, or from above the ceiling/wall panel (i.e., from a side opposite the room-facing side of the ceiling/wall), if installed after the ceiling/wall is constructed.

The lighting element 16 can be fixed to a lighting assembly 24 including a heat sink 28 thermally coupled to the lighting element 16. The lighting assembly 24 can also include a reflector 26 fixed thereto and disposed around the lighting element 16 such that it is configured to reflect light emitted by the lighting element 16 through the aperture 14 and into the room. The reflector 26 can include an open bottom 30 through which light exits the lighting assembly, where the bottom 30 is defined by a circumferential peripheral edge or flange 31 which can lie on a plane, and that plane can be perpendicular to an optical axis 32 of the light assembly 24. Preferably, the reflector 26 and/or bottom 30 thereof are symmetrical about the optical axis 32 and the optical axis 32 passes through a center of the bottom of the reflector.

The enclosure 12 preferably includes a substantially planar bottom wall 34 which, when the light fixture 10 is installed, is closely adjacent to and substantially parallel to the interior surface 20 of the ceiling/wall panel 18. A collar 36 extends downwardly from the bottom wall 34 of the enclosure 12, preferably perpendicularly to the bottom wall 34, and surrounds the aperture 14. When the light fixture 10 is installed, the collar 36 preferably extends into the opening 22 of the ceiling/wall 18 and is sized and shaped complementary to the opening 22 such that the collar 34 follows the contours of the opening 22 and such that a small gap 38 (e.g., ¼-½ inch) exists between an interior of the opening 22 and an exterior of the collar 36. Further, preferably the cut forming the opening 22 in the ceiling/wall 18 is made perpendicular to the plane of the ceiling/wall panel 18 to correspond to the configuration of the collar 36 and so that the opening 22 closely circumscribes the collar 36 (leaving a small gap there between). The opening 22 in the ceiling/wall 18 can be any shape. Typical shapes for the opening are round and square, but other shapes are possible. Thus, the shape of the collar 36 can be round or square, or other shapes.

In a sloped ceiling/wall 18, the support structure (e.g., joists) to which such recessed light fixtures are typically connected are themselves inclined at the same angle as the ceiling/wall panel 18 and the light fixture 10 is mounted with the bottom wall 34 of the enclosure 12 closely adjacent and parallel to the ceiling/wall panel 18 (e.g., closely adjacent and parallel to the interior surface 20 of the ceiling/wall panel 18). Thus, when installed, the recessed light fixture 10 is inclined at the same or similar angle as the ceiling/wall. However, it is often desirable to adjust the angle of the optical axis 32 of the light assembly 24 such that the optical axis 32 is vertical, or at another desired orientation/angle different than that of the ceiling/wall 18 and/or light fixture 10.

The light fixture 10 has mutually orthogonal X, Y and Z axes (See FIG. 1). The X axis is a longitudinal axis and is parallel to the bottom wall 34 of the enclosure 12. An angle of the X axis relative to a horizontal plane is equal to the angle of inclination of the light fixture when the light fixture is installed. The Z axis is a lateral axis which is parallel to the bottom wall of the enclosure and perpendicular to the X axis. The Z axis is horizontal when the light fixture 10 is installed. The X and Z axes define a plane substantially parallel to the ceiling/wall panel 18 when the light fixture is installed. The Y axis is normal axis, which is perpendicular to (normal to) the bottom wall 34 of the enclosure and which is perpendicular to the ceiling/wall panel 18, when the light fixture is installed.

To compensate for the angled orientation of the installed light fixture 10, the light assembly 24 is operable to pivot relative to the housing or enclosure 12 about the Z axis (e.g., pivot 90). Preferably the light assembly 24 can pivot relative to the enclosure 12, about the Z axis, within a range of angles, from a minimum angle of, for example, 14 degrees (See FIG. 1), to a maximum angle of, for example, 45 degrees (See FIG. 6).

The bottom wall 34 of the enclosure 12 can include an uphill end 54 and a downhill end 56 along the longitudinal X axis, where the uphill end 54 is vertically higher than the downhill end 56 when the light fixture 10 is installed. The light assembly 24 is preferably disposed primarily above an uphill half of the aperture 14 (i.e., a half closest to the uphill end 54 of the bottom wall 34 of the enclosure 12). The Z axis preferably passes through the reflector 26 of the light assembly 24, and the Z axis preferably displaced longitudinally (parallel to the X axis) from the optical axis 32 toward the uphill end 54.

A selectively engagable locking mechanism 35 (e.g., a locking lever) is operable to lock the light assembly 24 in a vertical (or other desired) orientation relative to enclosure 12. The locking mechanism 35 is accessible through the aperture 14, from within the room. Thus, when the recessed light fixture 10 is installed in the inclined ceiling/wall 18, the light assembly 24 can be aligned vertically or substantially vertically (or at another angle), and locked in place, such that the optical axis 32 of the light assembly 24 is vertical and light emitted from the light fixture 10 shines straight down.

The light fixture 10 includes trim elements having various configurations adapted for different ranges of incline of the enclosure 12 when installed. For example, the light fixture 10 can include a low-incline trim element 40 (See FIGS. 1-3) adapted for a low range of incline (e.g., 14-30 degrees) and a high-incline trim element 140 (See FIGS. 4-6) adapted for a high range of incline (e.g., 30-45 degrees).

Each trim element 40, 140 is adapted to selectively, removably mount to the collar 36 and/or the bottom wall 34 of the enclosure 12 (or other structure of the enclosure 12) such that the trim element is fixed relative to the enclosure 12 when mounted. The trim element 40, 140 is adapted to provide a light pathway for light to travel from the lighting element 14 to the room and to provide a finished appearance to the light fixture installation. When mounted, each trim element 40, 140 preferably extends from an interior (i.e., room-facing side) of the ceiling/wall panel 18, through the opening 22 and the aperture 14 and into an interior of the enclosure 12. The trim element 40, 140 can have an relatively large open bottom 42, 142 surrounded by a radially-outwardly extending, preferably opaque peripheral flange 44, 144 which is parallel to, and contacts an exterior surface 46 of the ceiling/wall panel 18 (i.e., the room-facing surface) and which extends over and covers the gap 38 between the opening 22 in the ceiling/wall and the collar 36 of the light fixture.

The trim element 40, 140 can have an upper portion 46, 146 with a relatively smaller opening covered by a light-transmitting optical element 48, 148 fixed thereto such as a lens and/or diffuser (e.g., a solite lens). The optical element 48, 148, and/or a top surface 50, 150 thereof, is preferably substantially planar and is preferably spaced from, and aligned at an acute angle relative to, a plane defined by the peripheral flange 44, 144 of the trim element 40, 140 (and relative to the ceiling/wall panel 18 when installed). A preferably opaque peripheral wall 52, 152 connects the bottom 42, 142 of the trim element to the upper portion 46, 146 thereof. When the trim element 40, 140 is installed, the optical element 48, 148 is disposed adjacent a bottom portion of the lighting assembly 24, such as the bottom 30 of a reflector 26. The optical element 48, 148 preferably has a sized and shape substantially the same as and/or corresponding to the size and shape of the bottom 30 of the reflector 26 of the light assembly 24 such that the optical element 48, 148 is sized and shaped to allow passage of all or substantially all of the light emitted from the light assembly 24. The light fixture can be configured for various sizes and shapes of ceiling/wall openings, and the trim element is sized and shaped for such openings.

The bottom 42, 142 and peripheral flange 44, 144 portions of both of the low-incline and high-incline trim elements 40, 140 can have the same shape and configuration (for the trim elements configured for a given opening size and shape). However, the upper portions 46, 146 of the low- and high-incline trim elements 40, 140 are configured differently as described herein, and the optical elements 48, 148 of the low- and high-incline trim elements 40, 140 are preferably aligned at different angles relative to the plane of the peripheral flange 44, 144 of the trim element. In particular, the relative angle ($\theta_1$, FIG. 1) between the optical element 48 of the low-incline trim element 40 and the plane of the peripheral flange 44 thereof is preferably less than the corresponding relative angle ($\theta_2$, FIG. 4) between the optical element 148 of the high-incline trim element 140 and the plane of the peripheral flange 144 thereof. As an example, such relative angle ($\theta_1$) of the optical element 48 of the low-incline trim element 40 can be 14-30 degrees, or more preferably an intermediate angle there between, for example a midpoint there between, or about 22-23 degrees, whereas such relative angle ($\theta_2$) of the optical element 148 of the high-incline trim element 40 can be 30-45 degrees, or more preferably an intermediate angle there between, for example a midpoint there between or about 37-38 degrees.

The optical axis 32 of the light assembly 24 will be perpendicular to the optical element 48, 148 when the lighting assembly 24 is pivoted relative to the enclosure 12 at an angle equal to the relative angle ($\theta_1$, $\theta_2$) of optical element 48, 148 the low- and high-incline trim elements 40, 140.

In addition, the optical element 48, 148 of each type of trim element 40, 140 can have a first end 58, 158 disposed between the optical axis 32, and the uphill end 54 of the bottom wall 34 of the enclosure when installed in the enclosure 12, and can have a second end 60, 160 disposed on the opposite side of the optical axis 32 when installed, that is, between the downhill end 56 of the bottom wall 34 of the enclosure and the optical axis 32. The first end 58, 158 of the optical element 48, 148 is closer to the plane of the peripheral flange 44, 144 than the second end 60, 160. Further, in the low-incline trim 40, a distance between the first end 58 of the optical element 48 and the plane of the peripheral flange 44 can be greater than a corresponding distance of the high-incline trim, specifically a distance between the first end 158 of the optical element 148 and the plane of the peripheral flange 144 of the high-incline trim. And, in the low-incline trim 40, a distance between the second end 60 of the optical element 48 and the plane of the peripheral flange 44 can be less than a corresponding distance of the high-incline trim, specifically a distance between the second end 160 of the optical element 148 and the plane of the peripheral flange 144 of the high-incline trim.

A purpose of the different configurations of the low- and high-incline trims, and in particular the different position and angle of the optical elements 48, 148 thereof, is to maintain a close (and minimal) but non-interfering distance between the optical element 48, 148 and the bottom portion of the (vertically-aligned) lighting assembly 24 (for example, as between the optical element 48, 148 and the bottom 30 of the reflector 26) throughout the range of ceiling inclines designated for the particular trim element.

Figure 2:
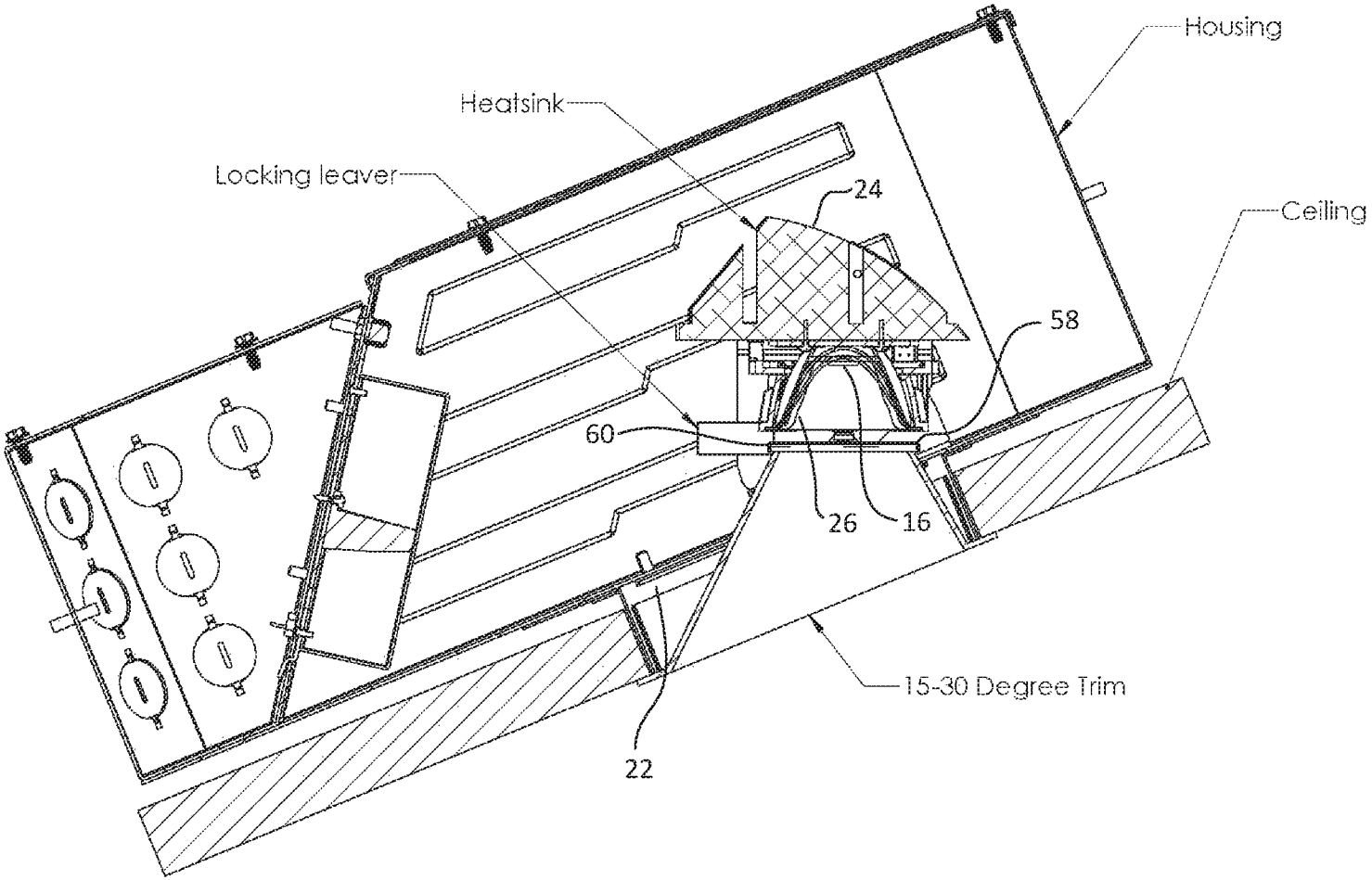
FIG. 2 is a side elevation view of a light fixture of FIG. 1 in a second inclination and with the first trim element.
Figure 3:
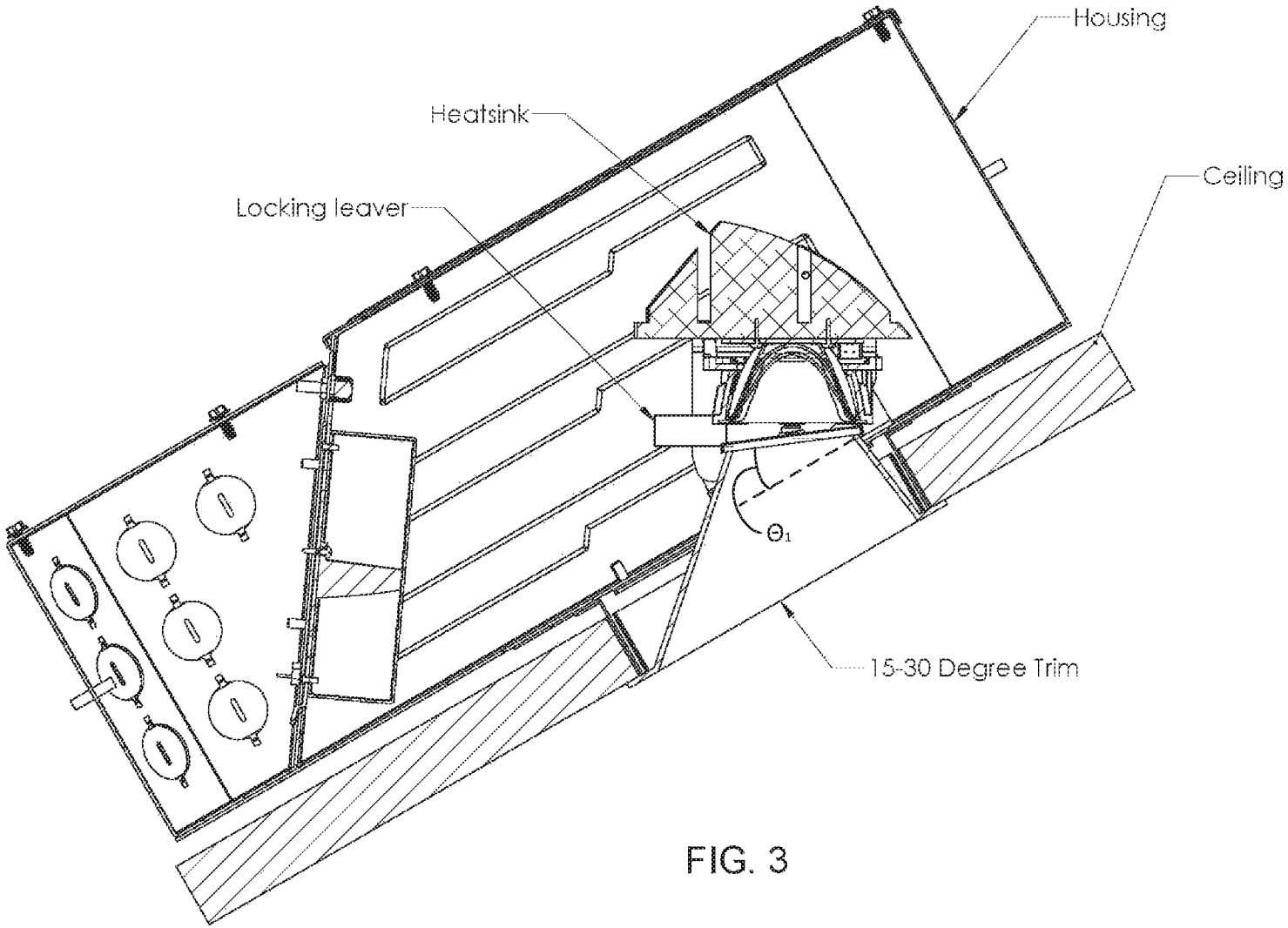
FIG. 3 is a side elevation view of a light fixture of FIG. 1 in a third inclination and with the first trim element.

FIGS. 1-3 depict the light fixture 10 installed in a ceiling/wall 18 at three progressively greater inclines suitable for the low-incline trim element 40, and in each incline the lighting assembly 24 is aligned vertically. FIG. 1 depicts the light fixture installed in a ceiling/wall 18 at a first or minimum incline of, for example, 14 degrees, which can be a minimum limit position which also allows vertical alignment of the lighting assembly 24. In this position, there is a relative angle between the lighting assembly 24 and the optical element 48 of the low-incline trim element 40 of preferably less than 10 degrees, and more preferably about 7.5 degrees, however the first and second ends 58, 60 of the optical element 48 are preferably spaced from and are not in contact the lighting element 48. FIG. 2 depicts the light fixture 10 installed at a second incline greater than the first incline, for example at about 22 degrees, and intermediate the first incline and a third incline depicted in FIG. 3. The second incline can be a midpoint between the first and third inclines. In the second incline, the optical element 48 can be parallel to the bottom 30 of the reflector 26 and perpendicular to the optical axis 32. FIG. 3 depicts the light fixture 10 installed in a ceiling/wall 18 having a third incline greater than the second incline, for example at 30 degrees. There is a relative angle between the lighting assembly 24 and the optical element 48, opposite to, and preferably equal to, the relative angle in the first incline (e.g., preferably less than 10 degrees, and more preferably about 7.5 degrees). As in the first incline, the first or second ends 58, 60 of the optical element 48 are preferably spaced from and are not in contact the lighting element 24.

In the first incline depicted in FIG. 1, the first end 58 of the optical element 48 is spaced from the lighting assembly 24 and/or the bottom 30 of the reflector 26 a distance preferably no greater than 0.50 in, and more preferably about 0.25 in., while the second end 60 is spaced a distance of about 0.08 in or less, preferably without contacting the lighting assembly 24. In the second incline position depicted in FIG. 2, the first and second ends 58, 60 of optical element 48 are equidistant from the lighting assembly 24 and/or the bottom 30 of the reflector 26, for example at a distance no greater than about 0.25 in or 0.22 in. In the third incline depicted in FIG. 3, the second end 60 of the optical element 48 is spaced from the lighting assembly 24 and/or the bottom 30 of the reflector 26 a distance preferably no greater than 0.50 in, and more preferably about 0.25 in., while the first end 60 is spaced a distance of about 0.08 in or less, preferably without contacting the lighting assembly 24.

Figure 4:
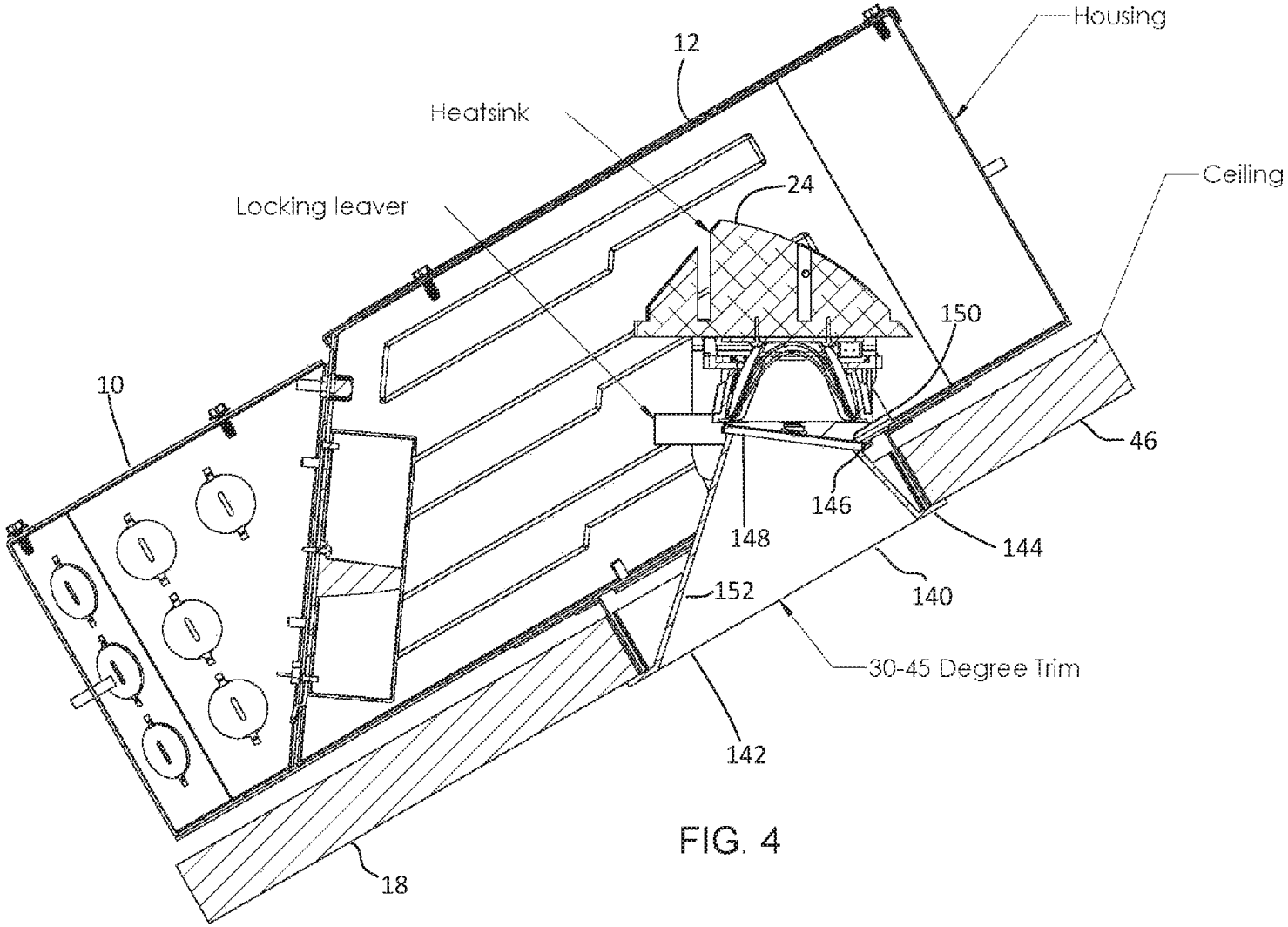
FIG. 4 is a side elevation view of a light fixture of FIG. 1 in a fourth inclination and with a second, high-incline trim element.
Figure 5:
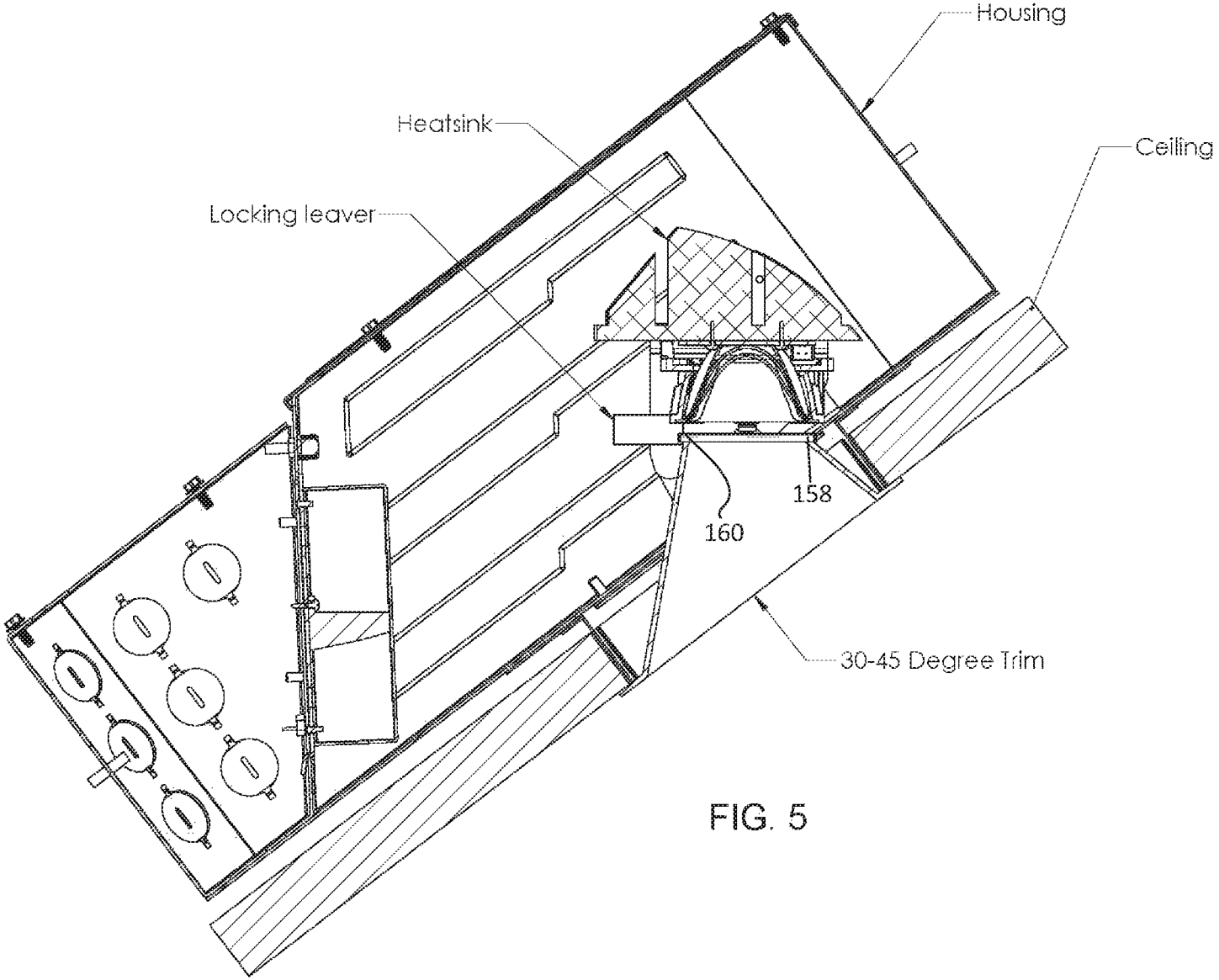
FIG. 5 is a side elevation view of a light fixture of FIG. 1 in a fifth inclination and with the second trim element.
Figure 6:
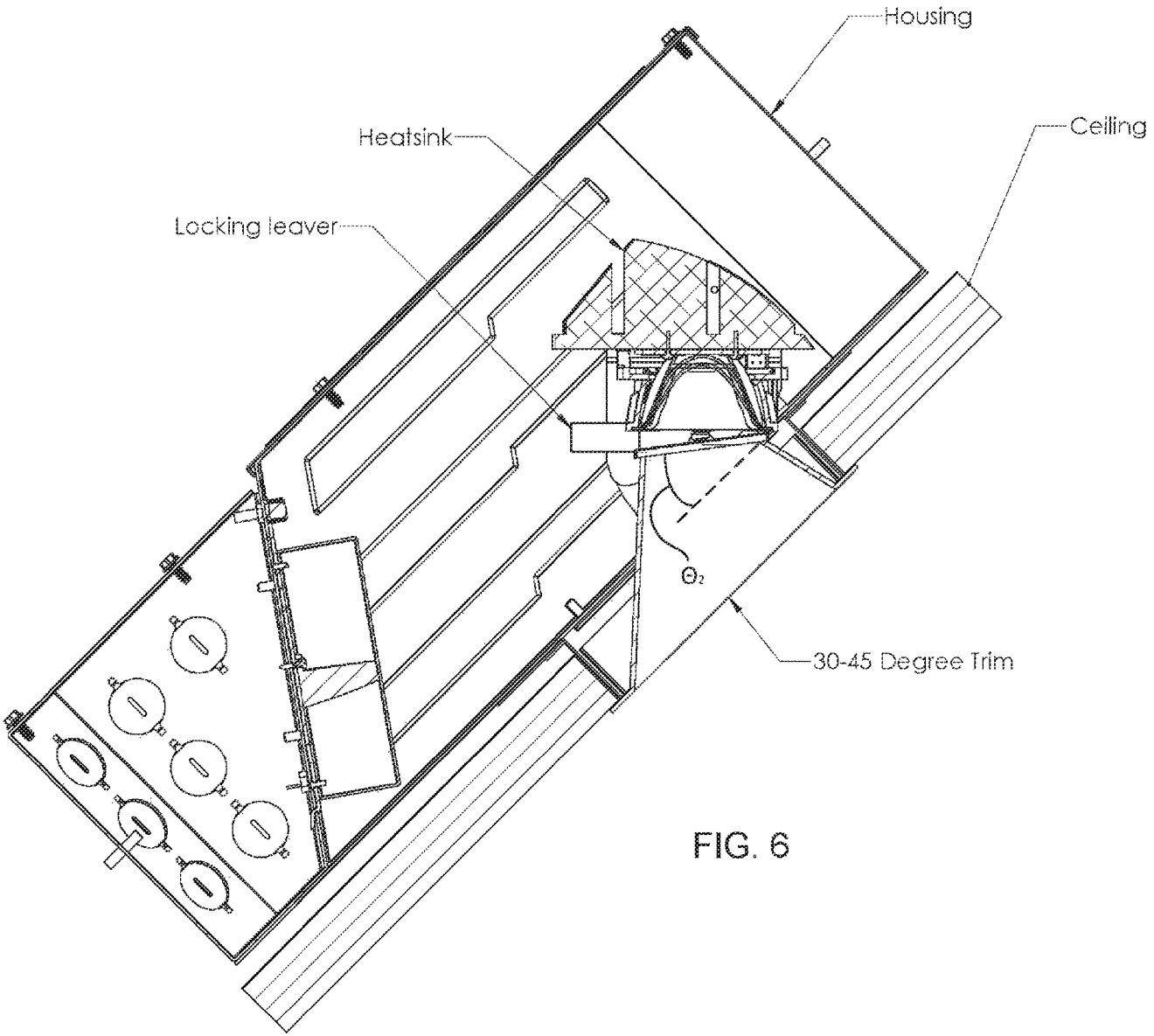
FIG. 6 is a side elevation view of a light fixture of FIG. 1 in a fifth inclination and with a second trim element.

FIGS. 4-6 depict the light fixture 10 installed in a ceiling/wall 18 at three progressively greater inclines suitable for the high-incline trim element 40, and in each incline the lighting assembly 24 is aligned vertically. FIG. 4 depicts the light fixture 10 installed in a ceiling/wall 18 at the third incline of, for example, 30 degrees. In this position, there is a relative angle between the lighting assembly 24 and the optical element 148 of the high-incline trim element 140 of preferably less than 10 degrees, and more preferably about 7.5 degrees, however the first and second ends 158, 160 of the optical element 148 are preferably spaced from and are not in contact the lighting element 148. FIG. 5 depicts the light fixture 10 installed at a fourth incline greater than the third incline, for example at about 37-38 degrees, and intermediate the third incline and a fourth incline depicted in FIG. 6. The fourth incline can be a midpoint between the third and fourth inclines. In the fourth incline, the optical element 148 can be parallel to the bottom 30 of the reflector 26 and perpendicular to the optical axis 32. FIG. 6 depicts the light fixture 10 installed in a ceiling/wall 18 having a fourth incline greater than the third incline, for example at 45 degrees, which can be a maximum incline limit position to allow vertical alignment of the lighting assembly 24. There is a relative angle between the lighting assembly 24 and the optical element 148, opposite to, and preferably equal to, the relative angle in the third incline (e.g., preferably less than 10 degrees, and more preferably about 7.5 degrees). As in the third incline, the first or second ends 58, 60 of the optical element 148 are preferably spaced from and are not in contact the lighting element 24.

In the first incline depicted in FIG. 4, the first end 158 of the optical element 148 is spaced from the lighting assembly 24 and/or the bottom 30 of the reflector 26 a distance preferably no greater than 0.50 in, and more preferably about 0.25 in., while the second end 60 is spaced a distance of about 0.08 in or less, preferably without contacting the lighting assembly 24. In the second incline position depicted in FIG. 5, the first and second ends 158, 160 of optical element 148 are equidistant from the lighting assembly 24 and/or the bottom 30 of the reflector 26, for example at a distance no greater than about 0.25 in or 0.22 in. In the third incline depicted in FIG. 6, the second end 160 of the optical element 148 is spaced from the lighting assembly 24 and/or the bottom 30 of the reflector 26 a distance preferably no greater than 0.50 in, and more preferably about 0.25 in., while the first end 160 is spaced a distance of about 0.08 in or less, preferably without contacting the lighting assembly 24.

Figure 7:
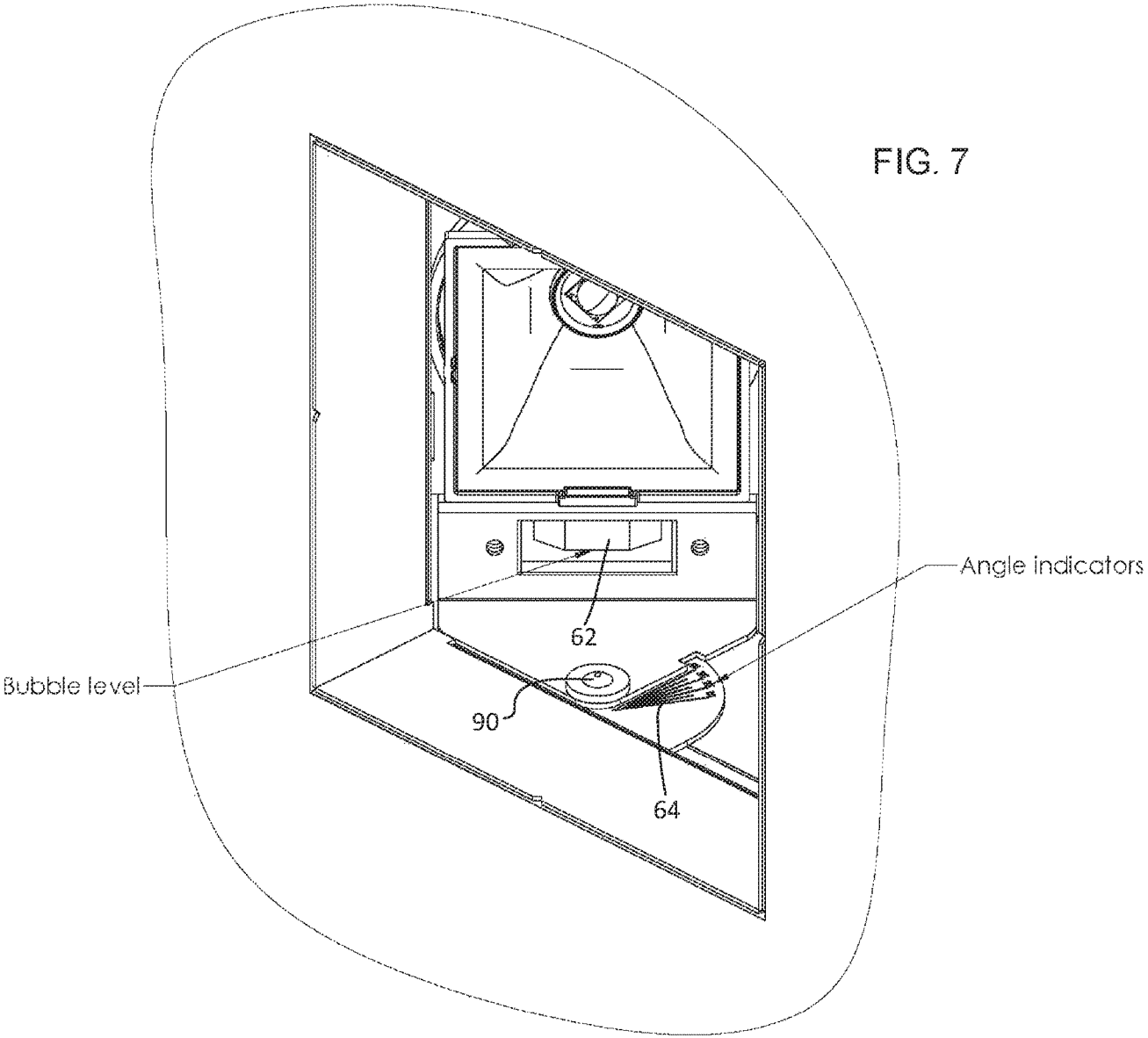
FIGS. 7-8 is a close-up, perspective view of the lighting assembly through the aperture, showing the bubble level and angle indicators.
Figure 8:
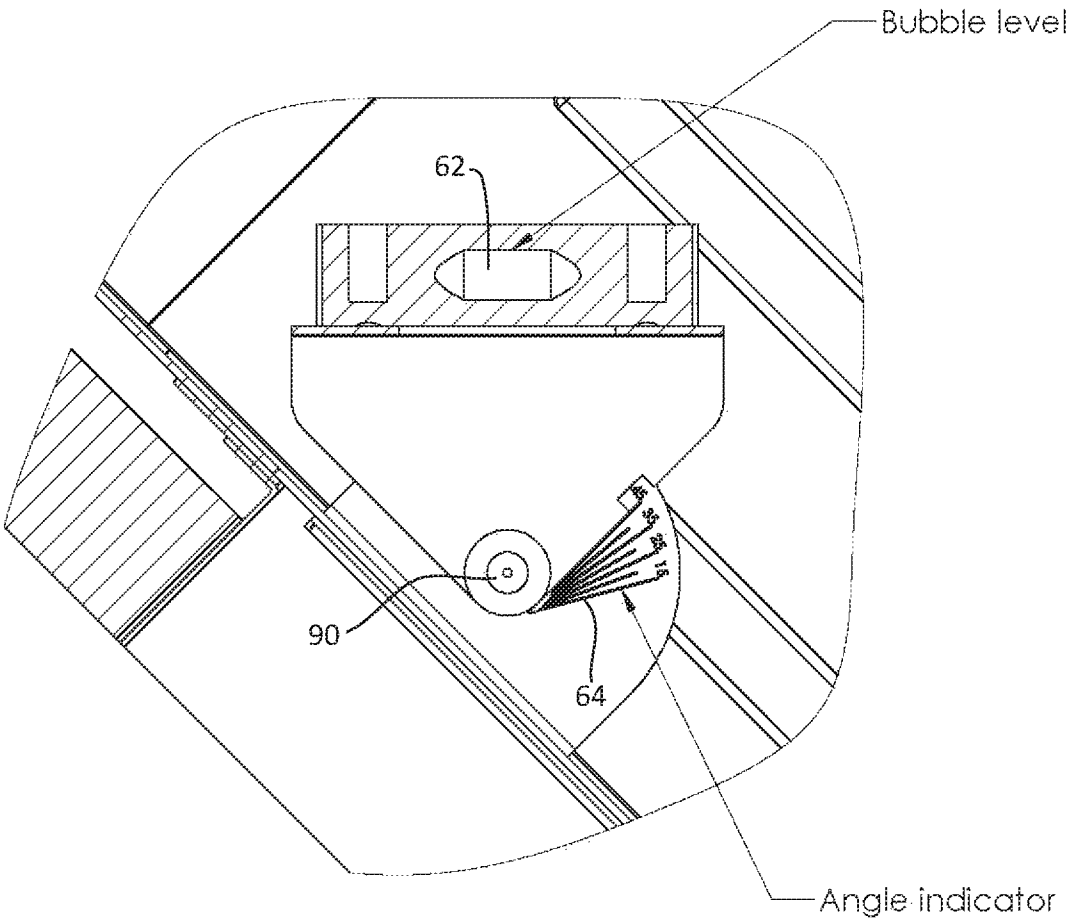
Figure 9:
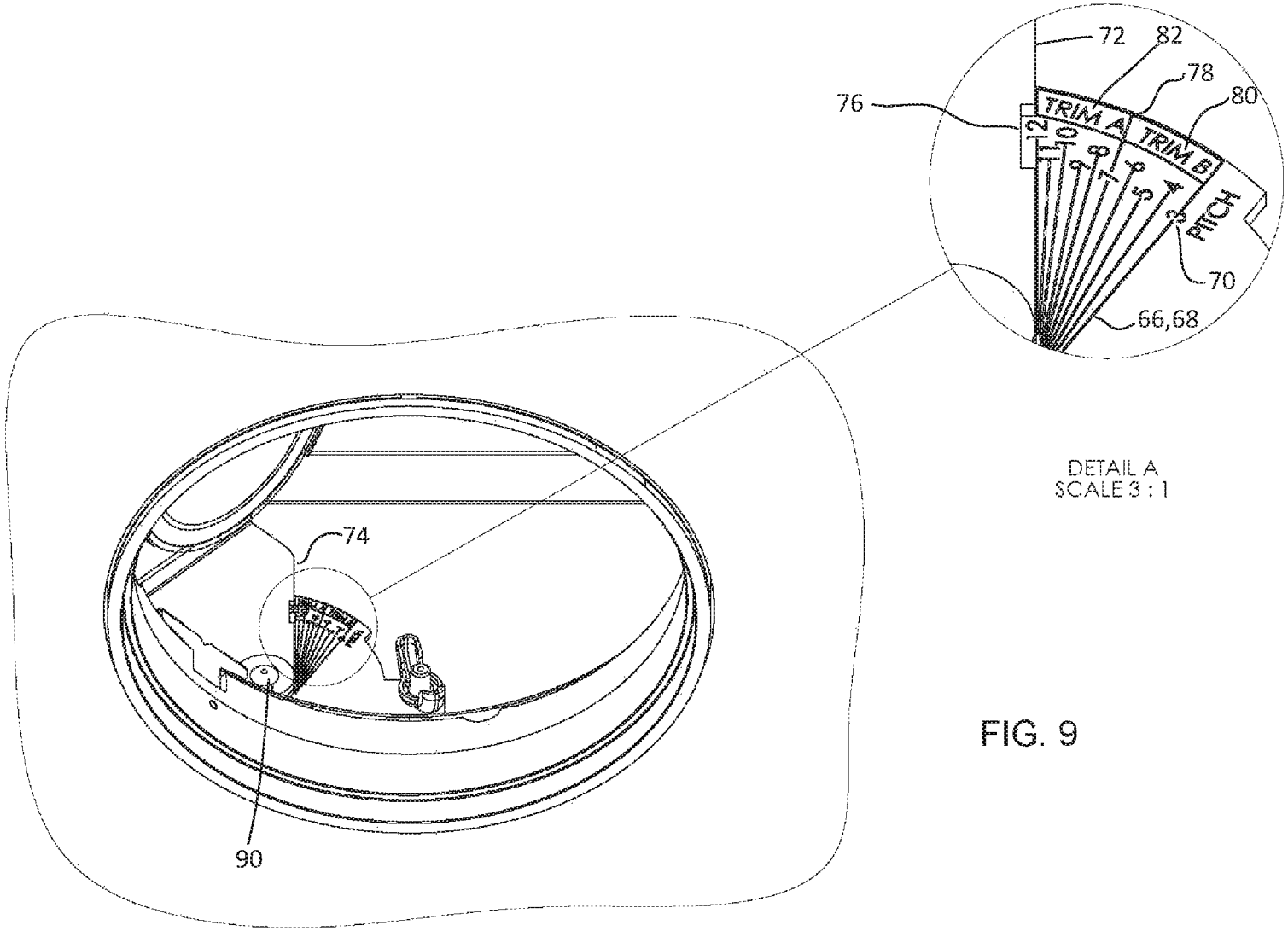
FIG. 9 is a close-up, perspective view of the lighting assembly through the aperture, showing the angle indicators and trim indicators.

Referring to FIGS. 7-9, a bubble level 62 can be fixed to the lighting assembly 24 and is operable to indicate when the lighting assembly 24 is aligned vertically (e.g., when an optical axis 32 of the lighting assembly 24 is vertical) and/or in one or more predetermined orientations. The bubble level 62 is preferably visible through the aperture 14 from a room-facing side of the light fixture 10 (at least when the trim element 40, 140 is removed) so that the level 62 is visible from within the room during and after installation of the light fixture 10. Thus, during or after installation of the light fixture 10, a user can adjust the angle of the lighting assembly 24 relative to the enclosure 12 to align the lighting assembly 24 in vertically or another predetermined orientation, without knowledge of the pitch of the ceiling.

Referring to FIGS. 7-9, the light fixture 10 can also include an angle indicator 64 which indicates a proper relative angle of the lighting assembly 24 to achieve vertical alignment (or another predetermined alignment) of the lighting assembly 24 (and the optical axis 32 thereof) for a plurality of inclinations of the enclosure 12 in a range inclinations, where the inclinations can be indicated in degrees and/or pitch. The angle indicator 64 is visible through the aperture 14 of the enclosure 12 from a room-facing side of the light fixture 10 so that the angle indicator 64 is visible during and after the light fixture is installed (at least when the trim is removed). The angle indicator 64 can include a plurality of markings 66 preferably fixed relative to the enclosure 12 and/or the bottom wall 34 thereof, including a plurality of line markings 68 indicating plurality of inclinations of the light fixture 10, for example among the first through sixth inclinations depicted in FIGS. 1-6, and including a plurality of numerical markings 70 providing a value of an associated line marking 68, for example in degrees and/or pitch. As depicted, the numerical markings 70 can disposed on, or in-line with, the associated line marking 68.

The angle indicator 64 also includes a pointer 72 preferably fixed relative to the lighting assembly 24 which is adapted to align with the markings 66 at a particular inclination, such as the line markings 68 and/or the associated numerical markings 70. The pointer 72 can comprise an edge 74 of the lighting assembly 24 which aligns with the line markings 68, and such edge 74 can include a recess 76 on a portion thereof, aligned with and adapted to permit viewing of the associated numerical markings 70. The relative positions of the markings 66 and pointer 72 can be reversed such that the markings 66 are fixed relative to the lighting assembly 24 and the pointer 72 is fixed relative to the housing 12.

The markings 66 of the angle indicator 64 also preferably include a trim indicator 78 which is operable to indicate which trim element, among the low-incline and high-incline trim elements 40, 140, should be used for a range of inclination angles. For example, as shown in FIG. 9, the trim indicator 78 can include a first trim indication 80 (e.g., "Trim B") to indicate use of the low-incline trim element 40, for the lower incline range (e.g., pitches 3/12-7/12), and can include a second trim indication 82 (e.g., "Trim A") to indicate use of the high-incline trim 140, for the higher incline range (e.g., pitches 7/12-12/12). Further, the low- and high-incline trim elements 40, 140 can include trim markings thereon (not shown) corresponding to the associated trim indications 80, 82, such as markings having "Trim B" and "Trim A", respectively, or other suitable markings.

The lighting fixture 10 described herein can be provided in a kit including the enclosure 12 with all of the components thereof described herein along with the low-incline trim element 40 and the high-incline trim element 140, and optionally mounting hardware for the light fixture.

A method of installing the lighting fixture 10 can include one or more of the steps (in any appropriate order) of providing the enclosure 12 with all of the components described herein, installing the enclosure 12 in an inclined ceiling/wall adjacent a ceiling/wall panel 18 in the manner and position described herein, adjusting an angle of the lighting assembly 24 relative to the enclosure 12 to a desired relative angle, such as a relative angle in which the optical axis 32 is vertical, optionally viewing the angle indicator 64 and/or bubble level 62 through the aperture 14 to attain the desired relative angle and/or vertical alignment of the optical axis 32, locking the lighting assembly 24 in the desired relative angle, optionally viewing the trim indicator 78 of the angle indicator 24 through the aperture 14 to determine the recommended trim element among the low-incline trim and the high-incline trim, selecting the appropriate trim element among the low-incline trim element and high-incline trim element, and mounting the selected trim element in the aperture 14.

As can be appreciated, the light fixture 10 can include three or more configurations of trim elements, which, for example, could comprise low-incline, mid-incline and high-incline trim elements adapted to for use within three adjacent ranges of relative inclination of the lighting assembly and enclosure, in the manner described herein.

It should be understood that the specific form of the invention herein illustrated and described is intended to be representative only, as certain changes may be made therein without departing from the clear teachings of the disclosure. Accordingly, reference should be made to the following appended claims in determining the full scope of the invention.

What is claimed is:

1. A recessed lighting fixture for installation in an inclined ceiling having an inclined ceiling panel with an opening and a support structure supporting the ceiling panel, the recessed lighting figure comprising:

an enclosure having a bottom wall with an aperture, and the enclosure being adapted to mount to the support structure with the bottom wall parallel to and closely adjacent an interior surface of the inclined ceiling panel, and with the aperture disposed above the opening in the inclined ceiling panel;

a lighting assembly disposed within the enclosure and including a lighting element operable to emit light and a reflector disposed around the lighting element, the lighting assembly being adapted to emit light through the aperture, and the lighting assembly having an optical axis;

the reflector having a first end disposed adjacent the lighting element and having a second end forming a reflector opening and having a circumferential edge defining a reflector plane perpendicular to the optical axis;

the lighting assembly being pivotal relative to the enclosure in a limited range of relative angles about a pivot axis which is horizontal when the enclosure is mounted to the support structure, the limited range of relative angles including a first range of relative angles of at least 15 degrees defined by a first relative angle and a second relative angle greater than the first relative angle;

a first trim element adapted for use with the first range of inclinations of the inclined ceiling panel, the first trim element being configured to mount in the aperture from a room-facing side of the enclosure, the first trim element having a lower end with an opening and a radially-outwardly extending circumferential flange disposed around the opening where the circumferential flange is adapted to contact a room-facing surface of the ceiling panel around the opening, and the circumferential flange defining a first plane parallel to the room-facing surface of the inclined ceiling panel;

the first trim element having an upper end with a light transmitting optical element mounted thereon and disposed adjacent the lighting assembly, and the optical element being inclined relative to the first plane about an axis parallel to the pivot axis at a first acute angle within the first range of relative angles; and when the lighting assembly is in the first and second relative angles, a relative angle between the optical element and the reflector plane being less than or equal to 10 degrees.

2. A recessed lighting fixture as in claim 1, wherein:

when the first trim element is installed and the lighting assembly is in a first intermediate relative angle relative to the first optical element, between the first and second relative angles, the first optical element is parallel to the reflector plane.

3. A recessed lighting fixture as in claim 2, wherein:

the first intermediate relative angle is a midpoint between the first and second relative angles.

4. A recessed lighting fixture as in claim 1, wherein:

the light fixture includes an angle indicator visible through the aperture from the room-facing side of the enclosure and adapted to indicate a proper relative angle of the lighting assembly relative to the enclosure for vertical alignment of the optical axis for a plurality of inclinations of the enclosure in the first range of inclinations; and the angle indicator includes a plurality of markings fixed to one of the enclosure and the lighting assembly and includes a pointer fixed to another of the enclosure and the lighting assembly;

wherein the pointer is adapted to align with the markings at a particular inclination indicated by the various markings.

5. A recessed lighting fixture as in claim 4, wherein:

the markings of the angle indicator include a plurality of line markings indicating various inclinations of the light fixture and include a plurality of numerical markings associated with the line markings indicating a value of an associated line marking.

6. A recessed lighting fixture as in claim 1, wherein:

the lighting assembly includes a bubble level fixed thereto and visible through the aperture, and the bubble level is adapted to indicate when the optical axis is aligned in a predetermined orientation.

7. A recessed lighting fixture as in claim 6, wherein: the bubble level is adapted to indicate when the optical axis is aligned in a vertical orientation.

8. A recessed lighting fixture as in claim 1, wherein the first relative angle is at least about 14 degrees.

9. A kit for a recessed lighting fixture for installation in an inclined ceiling having an inclined ceiling panel with an opening and a support structure supporting the ceiling panel, the kit for the recessed lighting figure comprising:

an enclosure having a bottom wall with an aperture, and the enclosure being adapted to mount to the support structure with the bottom wall parallel to and closely adjacent an interior surface of the inclined ceiling panel, and with the aperture disposed above the opening in the inclined ceiling panel;

a lighting assembly disposed within the enclosure and including a lighting element operable to emit light and a reflector disposed around the lighting element, the lighting assembly being adapted to emit light through the aperture, and the lighting assembly having an optical axis;

the reflector having a first end disposed adjacent the lighting element and having a second end forming a reflector opening and having a circumferential edge defining a reflector plane perpendicular to the optical axis;

the lighting assembly being pivotal relative to the enclosure in a limited range of relative angles about a pivot axis which is horizontal when the enclosure is mounted to the support structure, the limited range of relative angles including a first range of relative angles of at least 15 degrees defined by a first relative angle and a second relative angle greater than the first relative angle;

a first trim element adapted for use with the first range of inclinations of the inclined ceiling panel, the first trim element being configured to mount in the aperture from a room-facing side of the enclosure, the first trim element having a lower end with an opening and a radially-outwardly extending circumferential flange disposed around the opening where the circumferential flange is adapted to contact a room-facing surface of the ceiling panel around the opening, and the circumferential flange defining a first plane parallel to the room-facing surface of the inclined ceiling panel;

the first trim element having an upper end with a first optical element mounted thereon and adapted to be disposed adjacent the lighting assembly, and the first optical element being inclined relative to the first plane at a first acute angle within the first range of relative angles;

when first trim element is installed and the lighting assembly is in the first and second relative angles, a relative angle between the first optical element and the reflector plane being less than or equal to 10 degrees;

the limited range of relative angles including a second range of relative angles of at least 15 degrees defined by the second relative angle and a third relative angle greater than the second relative angle;

a second trim element adapted for use with the second range of inclinations of the inclined ceiling panel, the second trim element being configured to mount in the aperture from the room-facing side of the enclosure, the second trim element having a lower end with an opening and a radially-outwardly extending circumferential flange disposed around the opening where the circumferential flange is adapted to contact the room-facing surface of the ceiling panel around the opening, and the circumferential flange defining a second plane parallel to the room-facing surface of the inclined ceiling panel;

the second trim element having an upper end with a second optical element mounted thereon and adapted to be disposed adjacent the lighting assembly, and the second optical element being inclined relative to the second plane at a second acute angle within the second range of relative angles; and when the second trim element is installed and the lighting assembly is in the second and third relative angles, a relative angle between the second optical element and the reflector plane being less than or equal to 10 degrees.

10. A kit for a recessed lighting fixture, as in claim 9, wherein:

when the first trim element is installed and the lighting assembly is in a first intermediate relative angle relative to the first optical element, between the first and second relative angles, the first optical element is parallel to the reflector plane; and when the second trim element is installed and the lighting assembly is in a second intermediate relative angle relative to the first optical element, between the second and third relative angles, the second optical element is parallel to the reflector plane.

11. A kit for a recessed lighting fixture, as in claim 10, wherein:

the first intermediate relative angle is a midpoint between the first and second relative angles; and the second intermediate relative angle is a midpoint between the second and third relative angles.

12. A kit for a recessed lighting fixture as in claim 9, wherein:

the light fixture includes an angle indicator visible through the aperture from the room-facing side of the enclosure and adapted to indicate a proper relative angle of the lighting assembly relative to the enclosure for vertical alignment of the optical axis for a plurality of inclinations of the enclosure in the first and second ranges of inclinations; and the angle indicator includes a plurality of markings fixed to one of the enclosure and the lighting assembly and includes a pointer fixed to another of the enclosure and the lighting assembly;

wherein the pointer is adapted to align with the markings at a particular inclination indicated by the various markings.

13. A kit for a recessed lighting fixture as in claim 12, wherein:

the markings of the angle indicator include a plurality of line markings indicating various inclinations of the light fixture and include a plurality of numerical markings associated with the line markings indicating a value of an associated line marking.

14. A kit for a recessed lighting fixture as in claim 13, wherein:

the angle indicator includes a trim indicator operable to indicate a recommended trim element from among the first and second trim elements for use for a range of relative inclination angles;

the trim indicator includes a first trim indication configured to indicate use of the first trim element for relative inclination angles in the first range of relative angles, and includes a second trim indication configured to indicate use of the second trim element for relative inclination angles in the second range of relative angles.

15. A kit for a recessed lighting fixture as in claim 14, wherein:

the first trim element includes a first trim marking comprising the first trim indication; and the second trim element includes a second trim marking comprising the second trim indication.

16. A kit for a recessed lighting fixture as in claim 9, wherein the first relative angle is at least about 14 degrees.

17. A kit for a recessed lighting fixture for installation in an inclined ceiling having an inclined ceiling panel with an opening and a support structure supporting the ceiling panel, the kit for the recessed lighting figure comprising:

an enclosure having a bottom wall with an aperture, and the enclosure being adapted to mount to the support structure with the bottom wall parallel to and closely adjacent an interior surface of the inclined ceiling panel, and with the aperture disposed above the opening in the inclined ceiling panel;

a lighting assembly disposed within the enclosure and including a lighting element operable to emit light and a reflector disposed around the lighting element, the lighting assembly being adapted to emit light through the aperture, and the lighting assembly having an optical axis;

the reflector having a first end disposed adjacent the lighting element and having a second end forming a reflector opening and having a circumferential edge defining a reflector plane perpendicular to the optical axis;

the lighting assembly being pivotal relative to the enclosure in a limited range of relative angles about a pivot axis which is horizontal when the enclosure is mounted to the support structure, the limited range of relative angles including a first range of relative angles of at least 15 degrees defined by a first relative angle and a second relative angle greater than the first relative angle;

a first trim element adapted for use with the first range of inclinations of the inclined ceiling panel, the first trim element being configured to mount in the aperture from a room-facing side of the enclosure, the first trim element having a lower end with an opening and a radially-outwardly extending circumferential flange disposed around the opening where the circumferential flange is adapted to contact a room-facing surface of the ceiling panel around the opening, and the circumferential flange defining a first plane parallel to the room-facing surface of the inclined ceiling panel;

the first trim element having an upper end with a first optical element mounted thereon and adapted to be disposed adjacent the lighting assembly, and the first optical element being inclined relative to the first plane at an angle within the first range of relative angles;

when first trim element is installed and the lighting assembly is in the first and second relative angles, a relative angle between the first optical element and the reflector plane being less than or equal to 10 degrees;

the limited range of relative angles including a second range of relative angles of at least 15 degrees defined by the second relative angle and a third relative angle greater than the second relative angle;

a second trim element adapted for use with the second range of inclinations of the inclined ceiling panel, the second trim element being configured to mount in the aperture from the room-facing side of the enclosure, the second trim element having a lower end with an opening and a radially-outwardly extending circumferential flange disposed around the opening where the circumferential flange is adapted to contact the room-facing surface of the ceiling panel around the opening, and the circumferential flange defining a second plane parallel to the room-facing surface of the inclined ceiling panel;

the second trim element having an upper end with a second optical element mounted thereon and adapted to be disposed adjacent the lighting assembly, and the second optical element being inclined relative to the second plane at an angle within the second range of relative angles;

when the second trim element is installed and the lighting assembly is in the second and third relative angles, a relative angle between the second optical element and the reflector plane being less than or equal to 10 degrees;

the light fixture includes an angle indicator visible through the aperture from the room-facing side of the enclosure and adapted to indicate a proper relative angle of the lighting assembly relative to the enclosure for vertical alignment of the optical axis for a plurality of inclinations of the enclosure in the first and second ranges of inclinations;

the angle indicator includes a plurality of markings fixed to one of the enclosure and the lighting assembly, a pointer fixed to another of the enclosure and the lighting assembly, and a trim indicator operable to indicate a recommended trim element from among the first and second trim elements for use for a range of relative inclination angles;

the pointer is adapted to align with the markings at a particular inclination indicated by the various markings;

the markings of the angle indicator include a plurality of line markings indicating various inclinations of the light fixture and include a plurality of numerical markings associated with the line markings indicating a value of an associated line marking; and the trim indicator includes a first trim indication configured to indicate use of the first trim element for relative inclination angles in the first range of relative angles, and includes a second trim indication configured to indicate use of the second trim element for relative inclination angles in the second range of relative angles.

18. A kit for a recessed lighting fixture as in claim 17, wherein:

the first trim element includes a first trim marking comprising the first trim indication; and the second trim element includes a second trim marking comprising the second trim indication.

19. A kit for a recessed lighting fixture as in claim 17, wherein:

when the first trim element is installed and the lighting assembly is in a first intermediate relative angle relative to the first optical element, between the first and second relative angles, the first optical element is parallel to the reflector plane; and when the second trim element is installed and the lighting assembly is in a second intermediate relative angle relative to the first optical element, between the second and third relative angles, the second optical element is parallel to the reflector plane.

20. A kit for a recessed lighting fixture as in claim 17, wherein the first relative angle is at least about 14 degrees.

* * * * *